US008734172B2

(12) United States Patent
Takei et al.

(10) Patent No.: US 8,734,172 B2
(45) Date of Patent: May 27, 2014

(54) CONNECTOR COUPLING STRUCTURE AND HOLDER DEVICE

(75) Inventors: Eiichi Takei, Okazaki (JP); Hiroyoshi Araki, Okazaki (JP); Takemune Izumi, Okazaki (JP); Tatsuo Saito, Okazaki (JP)

(73) Assignees: Aisin AW Co., Ltd., Anjo (JP); Denso Corporation, Kariya (JP)

( * ) Notice: Subject to any disclaimer, the term of this patent is extended or adjusted under 35 U.S.C. 154(b) by 14 days.

(21) Appl. No.: 13/576,074

(22) PCT Filed: Feb. 15, 2011

(86) PCT No.: PCT/JP2011/053618

§ 371 (c)(1),
(2), (4) Date: Jul. 30, 2012

(87) PCT Pub. No.: WO2011/122158

PCT Pub. Date: Oct. 6, 2011

(65) Prior Publication Data

US 2012/0309222 A1 Dec. 6, 2012

(30) Foreign Application Priority Data

Mar. 31, 2010 (JP) ..... 2010-084025

(51) Int. Cl.
*H01R 13/64* (2006.01)
*H01R 13/631* (2006.01)

(52) U.S. Cl.
CPC ..... *H01R 13/6315* (2013.01)
USPC ..... 439/248; 439/374; 439/378

(58) Field of Classification Search
USPC ..... 439/374, 378, 247, 248
See application file for complete search history.

(56) References Cited

U.S. PATENT DOCUMENTS 5,993,241 A * 11/1999 Olson et al. ..... 439/378
6,234,817 B1 * 5/2001 Hwang ..... 439/247
6,405,447 B2 * 6/2002 Nyen ..... 33/645
6,773,283 B2 * 8/2004 Yoshimatsu et al. ..... 439/180

(Continued)

FOREIGN PATENT DOCUMENTS

EP 0 571 037 A1 11/1993
JP A-08-031509 2/1996

(Continued)

OTHER PUBLICATIONS

Russian Patent Office, Decision on Grant mailed on Oct. 18, 2013 in Russian Patent Application No. 2012136219/07(058712) w/English-language Translation.

(Continued)

*Primary Examiner* — Neil Abrams
*Assistant Examiner* — Travis Chambers
(74) *Attorney, Agent, or Firm* — Oliff PLC

(57) ABSTRACT

A connector portion of a hard disk device is provided with a recess portion that guides a connector portion of a holder device so as to align the connector portion of the holder device with the connector portion of the hard disk device. The connector portion of the holder device is provided with a guide projection that is guided by the recess portion. A connector body is attached to a holder body shiftable within a range that the connector portion of the holder device can follow the connector portion of the hard disk device and a range that the guide projection can be guided by the recess portion.

8 Claims, 8 Drawing Sheets

(56) References Cited

U.S. PATENT DOCUMENTS

| | | | | |
|---|---|---|---|---|
| 6,860,028 | B2 * | 3/2005 | Charest et al. | 33/645 |
| 6,918,177 | B2 * | 7/2005 | Haager et al. | 29/832 |
| 7,473,114 | B2 * | 1/2009 | Chen et al. | 439/159 |
| 7,611,359 | B2 * | 11/2009 | Tomizu et al. | 439/74 |
| 7,658,637 | B2 * | 2/2010 | Matsuzawa | 439/377 |
| 2004/0216318 | A1 | 11/2004 | Charest et al. | |
| 2007/0249200 | A1 | 10/2007 | Chen et al. | |
| 2008/0026622 | A1 * | 1/2008 | Tomizu et al. | 439/247 |
| 2009/0104810 | A1 | 4/2009 | Matsuzawa | |

FOREIGN PATENT DOCUMENTS

| | | |
|---|---|---|
| JP | A-2007-035376 | 2/2007 |
| JP | A-2009-104851 | 5/2009 |
| RU | 2 102 288 C1 | 1/1998 |
| WO | WO 97/31821 | 9/1997 |

OTHER PUBLICATIONS

Apr. 6, 2011 International Search Report issued in International Patent Application No. PCT/JP2011/053618.

Apr. 6, 2011 Written Opinion of the International Searching Authority issued in International Patent Application No. PCT/JP2011/053618.

Apr. 27, 2012 International Preliminary Report on Patentability issued in International Patent Application No. PCT/JP2011/053618.

Japanese Patent Office, Notification of Reason(s) for Refusal mailed Nov. 19, 2013 in Japanese Patent Application No. 2010-084025 w/Partial English-language Translation.

* cited by examiner

CONNECTOR COUPLING STRUCTURE AND HOLDER DEVICE

TECHNICAL FIELD

The present invention relates to a connector coupling structure that, when an electronic device is inserted into a holder device, electrically connects a connector terminal of a first connector provided in the electronic device and a connector terminal of a second connector provided in the holder device, and relates to a holder device that is electrically connected to an electronic device through the connector coupling structure.

BACKGROUND ART

As vehicle navigation devices, there are known navigation devices having a configuration in which a hard disk device, that is, an electronic device, is detachably mounted to a holder device. In such navigation devices, a connector that is provided on the hard disk device side and a connector that is provided on the holder device side may have manufacturing errors. For this reason, the connectors may not be suitably aligned when mounting the hard disk device to the holder device, making it difficult to connect connector terminals of both connectors.

There are known navigation devices in recent years that are provided with a floating mechanism that shifts the connector on the holder device side and the connector on the hard disk device side relative to one another (see Japanese Patent Application Publication No. JP-A-2007-35376, for example). In the navigation device described in JP-A-2007-35376, the floating mechanism is provided on the connector terminal of the second connector on the holder device side. The connector terminal of the second connector elastically deforms so as to absorb a misalignment relative to the first connector on the hard disk device side. As a consequence, when mounting the hard disk device to the holder device, the connector terminal of the first connector on the hard disk device side and the connector terminal of the second connector on the holder device side are surely connected.

However, in the navigation device described in JP-A-2007-35376, an unnecessary force that follows an elastic return force of the connector terminal of the second connector is applied between the connector terminal of the first connector and the connector terminal of the second connector. In such case, a load is applied to a soldered portion that joins the connector terminal of the first connector to a circuit board accommodated inside the hard disk device, and to a soldered portion that joins the connector terminal of the second terminal to a circuit board accommodated inside the holder device. This load may reduce the mechanical life of the soldered portions.

SUMMARY OF INVENTION

The present invention was devised in light of the foregoing circumstances, and it is an object of the present invention to provide a connector coupling structure and a holder device, wherein when mounting an electronic device to the holder device, a connector terminal of a connector on the electronic device side is surely connected to a connector terminal of a connector on the holder device side, and an unnecessary force applied between the connector terminal of the connector on the electronic device side and the connector terminal of the connector on the holder device side is suppressed.

To achieve the above object, a connector coupling structure according to the present invention, when an electronic device is inserted into a holder device, electrically connects a connector terminal of a first connector provided in the electronic device and a connector terminal of a second connector provided in the holder device. In the connector coupling structure, the holder device includes a holder body into which the electronic device is inserted, and a connector body provided with the second connector is shiftably attached to the holder body. The first connector is provided with a guide portion that guides the second connector such that the connector terminal of the second connector aligns with the connector terminal of the first connector. The second connector is provided with a guided portion that is guided by the guide portion when the second connector is shifted. The connector body, when a center position of a mobile area of the connector body with respect to the holder body is set as a reference position, is attached to the holder body shiftable within a range that the second connector can follow the first connector shifted with respect to the reference position in a direction that intersects an insertion direction of the electronic device, and within a range that the guided portion can be guided by the guide portion.

According to the constitution described above, the connector body shifts with respect to the holder body while shifting the second connector so as to align with the first connector. Here, the connector body is shiftable with respect to the holder body within a range that the guided portion can be guided by the guide portion. Therefore, when the electronic device is inserted into the holder body, the guided portion is reliably guided by the guide portion. Accordingly, during insertion of the electronic device into the holder body, the connector terminal of the first connector and the connector terminal of the second connector can be surely connected.

In addition, the connector body can shift with respect to the holder body within a range that the second connector can follow the first connector. Therefore, after the connectors are connected, even if the electronic device becomes misaligned with respect to the holder body and the first connector is shifted with respect to the holder body, the second connector shifts with respect to the holder body so as to follow the first connector. Accordingly, an unnecessary force acting between the connector terminal of the first connector and the connector terminal of the second connector can be suppressed.

In the connector coupling structure according to the present invention, a sum total of a shift amount that the first connector can be shifted with respect to the reference position in the direction that intersects the insertion direction of the electronic device and a shift amount that the second connector can be shifted with respect to the reference position in the same direction is smaller than a guidance amount that the guide portion moves the guided portion in the same direction during insertion of the electronic device into the holder body. Also, the shift amount that the second connector can be shifted with respect to the reference position in the direction that intersects the insertion direction of the electronic device is larger than the shift amount that the first connector can be shifted with respect to the reference position in the same direction.

According to the constitution described above, the amount that the guided portion is guided by the guide portion is set larger than the shift amount that the second connector can be shifted with respect to the first connector. Therefore, the range in which the second connector can shift with respect to the first connector is restricted by the range in which the guided portion can be guided by the guide portion. Accordingly, during insertion of the electronic device into the holder body, the connector terminal of the first connector and the connector terminal of the second connector can be surely connected.

The shift amount that the second connector can be shifted with respect to the reference position is set larger than the shift amount that the first connector can be shifted with respect to the reference position. Therefore, after the connectors are connected, even if the electronic device becomes misaligned with respect to the holder body and the first connector is shifted with respect to the reference position, the second connector shifts with respect to the holder body so as to follow the first connector. Accordingly, an unnecessary force acting between the connector terminal of the first connector and the connector terminal of the second connector can be suppressed.

In the connector coupling structure according to the present invention, the connector body is formed with a through hole that penetrates in the insertion direction of the electronic device, and an attachment member that attaches the connector body to the holder body is inserted into the through hole with a gap in the direction that intersects the insertion direction of the electronic device interposed between the attachment member and the through hole. Also, the gap formed between the attachment member and the through hole, with the connector body located at the center position of the mobile area with respect to the holder body, has a dimension in the direction that intersects the insertion direction of the electronic device that corresponds to the shift amount that the connector body can be shifted with respect to the reference position in the same direction.

According to the constitution described above, when the attachment member attaches the connector body to the holder body, the shift amount that the second connector can be shifted with respect to the first connector is set smaller than the amount that the guided portion is guided by the guide portion. The shift amount that the second connector can be shifted with respect to the reference position is set larger than the shift amount that the first connector can be shifted with respect to the reference position. Therefore, at the time of insertion of the electronic device into the holder body, the connector terminal of the first connector can be surely connected to the connector terminal of the second connector, and an unnecessary force acting between the connector terminal of the first connector and the connector terminal of the second connector can be suppressed.

In the connector coupling structure according the present invention, the attachment member is a shoulder screw that has a non-screw portion on a base end side thereof in an axial direction, and has a screw portion with a smaller diameter than the non-screw portion more toward a distal end side thereof in the axial direction than the non-screw portion. Also, a dimension of the non-screw portion in the axial direction is set larger than a dimension of the through hole in the same direction, and the screw portion is threadedly fastened to the holder body with a gap interposed between the non-screw portion and an inner surface of the through hole.

According to the constitution described above, a constitution in which the connector body is shiftably attached to the holder body can be easily achieved.

In the connector coupling structure according to the present invention, the guide portion has a guide surface that is inclined with respect to the insertion direction of the electronic device, and the guided portion has a guided surface that slides against the guide surface. Also, an amount that the guide portion guides the guided portion is a sum total of a dimension of the guide surface in a direction that the guided portion is guided by the guide portion and a dimension of the guided surface.

According to the constitution described above, the guide portion can guide the guided portion by sliding the guide surface of the guide portion against the guided surface of the guided portion.

Further, in the connector coupling structure according to the present invention, the holder body has a holding portion that holds the electronic device in the direction that intersects the insertion direction of the electronic device.

According to the constitution described above, when the electronic device is inserted into the holder body, the electronic device is mounted to the holder body in a non-shiftable manner by the holding portion of the holder body holding the electronic device. Therefore, even if vibrations propagate to the holder body from outside for example, the connector terminal of the first connector can be stably connected to the connector terminal of the second connector.

The connector coupling structure according to present invention further includes a housing that accommodates therein the holder device so as to surround a periphery of the holder device, wherein the connector body is disposed on an inward side of the housing.

According to the constitution described above, by simply inserting the electronic device in one direction with respect to the holder device, the connector terminal of the first connector can be electrically connected to the connector terminal of the second connector. Therefore, even if the connector body is located at a position on the inward side of the housing, the connector terminal of the first connector and the connector terminal of the second connector can be connected by a simple operation without disassembling the housing.

A holder device according to the present invention includes: a holder body that is inserted with an electronic device; a second connector that has a connector terminal that electrically connects to a connector terminal of a first connector provided in the electronic device when the electronic device is inserted into the holder body; and an attachment member that shiftably attaches the connector body provided with the second connector to the holder body. The second connector is provided with a guided portion that is guided by a guide portion provided on the first connector when the second connector is shifted. The attachment member, when a center position of a mobile area of the connector body with respect to the holder body is set as a reference position, attaches the connector body to the holder body shiftable within a range that the second connector can follow the first connector shifted from the reference position in a direction that intersects an insertion direction of the electronic device, and within a range that the guided portion can be guided by the guide portion.

The above constitution obtains the same effects as the invention of the connector coupling structure.

DESCRIPTION OF EMBODIMENTS

Figure 1:
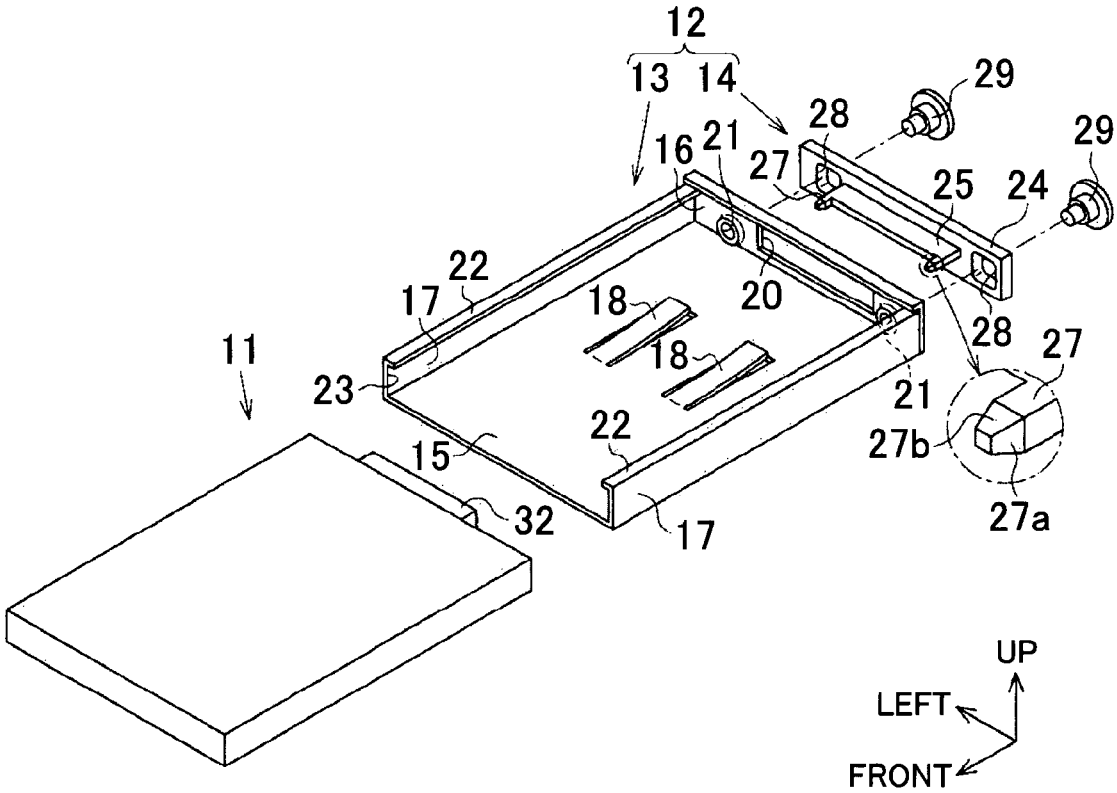
FIG. 1 is an exploded perspective view of a hard disk device and a holder device according to an embodiment.

A specific embodiment of the present invention in a vehicle navigation device will be described below with reference to FIGS. 1 to 8. Note that in the following description of the present specification, a front-back direction, a left-right direction, and an up-down direction indicate directions illustrated by arrows in the drawings.

FIG. 1 is an exploded perspective view that, among components of a navigation device, shows a hard disk device 11 serving as an electronic device mounted to a holder device 12.

As illustrated in FIG. 1, the holder device 12 includes a holder body 13 having a substantially frame-like configuration, and a connector body 14 that is attached to the holder body 13.

The holder body 13 includes a bottom plate 15 having a rectangular plate shape, a back plate 16 that is provided standing on an end edge located on the back side of the bottom plate 15, and a pair of side plates 17 that are provided standing on end edges located on both left and right sides of the bottom plate 15.

An elastic tab portion 18 is formed at two sites that are located in the general center of the upper surface of the bottom plate 15. The elastic tab portions 18 are arranged at positions with left-right symmetry using the center position in the left-right direction on the upper surface of the bottom plate 15 as a reference. In addition, the elastic tab portions 18 are formed having a cantilever configuration, wherein the front end side thereof is an end fixed to the bottom plate 15, and the back end side thereof is a free end. The back end sides of the elastic tab portions 18 are elastically deformable in the up-down direction using the fixed end on the front end side as a fulcrum. Note that the elastic tab portions 18 have upward-curving configurations, so the back end sides of the elastic tab portions 18 project upward from the upper surface of the bottom plate 15.

In addition, a through portion 20 having a rectangular shape is formed located at the general center in the left-right direction of the back plate 16 so as to penetrate the back plate 16 in the front-back direction. A pair of circular-shaped screw holes 21 are formed at positions on both left and right sides of the back plate 16, with the through portion 20 interposed therebetween, so as to penetrate the back plate 16 in the front-back direction.

An extension portion 22 is formed extending from each upper end of the pair of left and right side plates 17 parallel to the upper surface of the bottom plate 15 and toward the center position in the left-right direction of the holder body 13. On the front surface side of the holder body 13, an insertion opening 23 that allows insertion of the hard disk device 11 into the holder body 13 is formed by the bottom plate 15, the pair of side plates 17, and the extension portions 22. The hard disk device 11 is mounted to the holder body 13 by inserting the hard disk device 11 through the insertion opening 23 and into the holder body 13.

Note that when inserting the hard disk device 11 through the insertion opening 23 and into the holder body 13, the inner surfaces of the pair of side plates 17 slide against the side surfaces on both left and right sides of the hard disk device 11. The sliding movement of the hard disk device 11 in the front-back direction is thus guided by the pair of side plates 17.

When mounting the hard disk device 11 to the holder body 13, the elastic tab portions 18 provided in the bottom plate 15 of the holder body 13 are pressed by the lower surface of the hard disk device 11 and thus bent downward and deformed. Once mounting of the hard disk device 11 to the holder device 12 is complete, the lower surface of the hard disk device 11 is biased upward in accordance with the elastic return force of the elastic tab portions 18. At such time, the elastic return force of the elastic tab portions 18 functions as a biasing force that is capable of holding the hard disk device 11 in the up-down direction between the elastic tab portions 18 and the extension portions 22 of the pair of side plates 17. With regard to this point, in the present embodiment, the elastic tab portion 18 and the extension portion 22 of the side plate 17 function as holding portions that hold the hard disk device 11 in the up-down direction, which intersects the insertion direction (front-back direction) of the hard disk device 11.

The connector body 14 includes a plate portion 24 having a rectangular plate shape, and a connector portion 25 (second connector) having a generally rectangular plate shape that is connected to the plate portion 24. The plate portion 24 is arranged such that the front surface thereof faces the holder body 13 in the front-back direction, and the longer side direction thereof is the left-right direction and the shorter side direction thereof is the up-down direction. In addition, the connector portion 25 is connected to the front surface of the plate portion 24 such that the longer side direction of the connector portion 25 follows the longer side direction of the plate portion 24, and the shorter side direction of the connector portion 25 follows the shorter side direction of the plate portion 24. The connector portion 25 is also arranged located at the general center of the front surface of the plate portion 24 so as to correspond to the through portion 20 formed in the back plate 16 of the holder body 13. Note that, in the present embodiment, a serial ATA type of connector is provided as the connector portion 25.

A connector terminal 25*a* (see FIG. 3A) is provided located at the general center of the front surface of the connector portion 25. The connector terminal 25*a* is connected to a wire and a flexible printed board that are not shown in the drawings by pressure bonding, soldering, or the like, or connected to a rigid relay board that is not shown in the drawings by soldering. Consequently, the connector terminal 25*a* is electrically connected to a main board that executes various types of information processing inside the hard disk device 11. It should also be noted that the wire, flexible printed board, and relay board mentioned above are connected to the connector terminal 25*a* in a manner that does not interfere with the movement of the connector terminal 25*a*.

The connector portion 25 is provided with guide projections 27 serving as guided portions located on both left and right sides thereof with the connector terminal 25*a* interposed therebetween, such that the guide projections 27 project forward from the front surface of the connector portion 25. The distal end portions of the guide projections 27 are chamfered. Therefore, the distal end portion of the guide projection 27 is formed with tapered surfaces 27*a* serving as guided surfaces whose width in the left-right direction progressively decreases from the base end side of the guide projection 27 toward the distal end side, and tapered surfaces 27*b* serving as guided surfaces whose width in the up-down direction progressively decreases from the base end side of the guide projection 27 toward the distal end side.

Through holes 28 having a rectangular shape are formed at positions on both left and right sides of the front surface of the plate portion 24, with the connector portion 25 interposed therebetween, so as to penetrate the connector body 14 in the front-back direction. The through holes 28 are formed at positions that correspond to the screw holes 21 formed in the back plate 16 of the holder body 13. The connector body 14 is attached to the holder body 13 in a state with the through holes 28 formed in the plate portion 24 aligned with the screw holes 21 formed in the back plate 16 of the holder body 13. In other words, in such an attached state, the connector portion 25 of the connector body 14 is inserted from behind into the through portion 20 formed in the back plate 16 of the holder body 13, and shoulder screws 29 serving as attachment members are inserted from the back surface side of the connector body 14 into the through holes 28.

Figure 2:
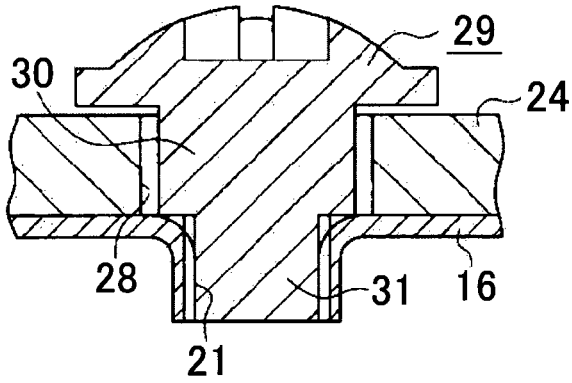
FIG. 2 is a cross-sectional view of an attachment region on a connector body for a holder body.

As illustrated in FIG. 2, the shoulder screw 29 includes a shoulder portion 30 that serves as a non-screw portion having a generally cylindrical shape on the base end side of the shoulder screw 29 in the axial direction, and a generally cylindrical-shaped screw portion 31 that has a smaller diameter than the shoulder portion 30 and is positioned more toward the distal end side of the shoulder screw 29 in the axial direction than the shoulder portion 30. Further, with the shoulder screw 29 inserted into the through hole 28, the screw portion 31 that projects forward from the front surface of the connector body 14 is threadedly fastened to the screw hole 21 formed in the back plate 16 of the holder body 13.

Note that the screw holes 21 are formed by first burring from the back surface side of the back plate 16 to form a circular-shaped depressed region, and then threading the inner circumferential surface of the depressed region. In addition, the diameter of the shoulder portion 30 of the shoulder screw 29 is designed so as to be smaller than the hole diameter of the through hole 28 in the up-down direction and the left-right direction. The shoulder portion 30 of the shoulder screw 29 is inserted into the through hole 28 with a gap maintained between the inner surface of the through hole 28 and the shoulder portion 30 in the up-down direction and the left-right direction. In addition, the height of the shoulder portion 30 of the shoulder screw 29 is designed so as to be slightly greater than the thickness of the plate portion 24 of the connector body 14 in the front-back direction. Therefore, by threadedly fastening the screw portion 31 of the shoulder screw 29 to the screw hole 21 of the holder body 13, the bottom surface of the shoulder portion 30 of the shoulder screw 29 contacts the back plate 16 of the holder body 13, and a slight clearance is secured in the front-back direction between the plate portion 24 of the connector body 14 and the back plate 16 of the holder body 13. Thus, inserting the shoulder screw 29 into the through hole 28 and threadedly fastening the shoulder screw 29 to the screw hole 21 of the holder body 13 enables the connector holder 14 to be attached to the holder body 13 in a manner that allows shifting in the up-down direction and the left-right direction.

Figure 3A:
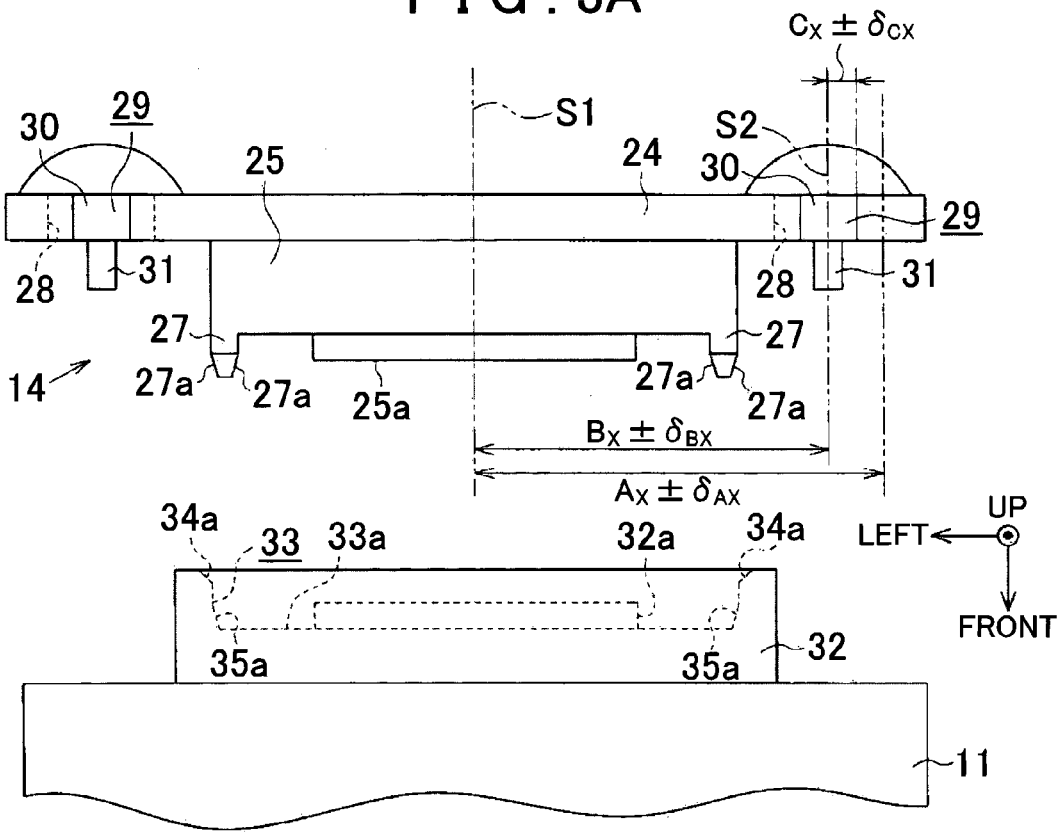
FIG. 3A is a plane view of a connector portion of the hard disk device and a connector portion of the holder device.

As illustrated in FIG. 3A, located at the general center of the rear surface of the hard disk device 11, a connector portion 32 (first connector) is provided that projects backward and is connected to the connector portion 25 of the holder device 12. In addition, the back surface that is the distal end surface of the connector portion 32 is provided such that a recess portion 33, which is depressed in the front direction from the back surface of the connector portion 32, generally extends over the entire area of the connector portion 32 in the left-right direction. The inner surface of the recess portion 33 slides against the guide projections 27 of the connector portion 25 provided on the holder device 12 side, and thus functions as a guide portion that guides the guide projections 27 so as to shift in the left-right direction.

A connector terminal 32*a* is provided located at the general center of a bottom surface 33*a* that is positioned on the inward side of the recess portion 33. When the distal end of the connector portion 25 provided in the holder device 12 is inserted into the recess portion 33, the connector terminal 25*a* of the connector portion 25 provided in the holder device 12 is electrically connected to the connector terminal 32*a* of the connector portion 32 provided in the hard disk device 11.

Note that both end portions in the left-right direction on the opening edge of the recess portion 33 are formed with tapered surfaces 34*a* serving as guide surfaces whose width in the left-right direction progressively decreases toward the front side that is also the inward side. Likewise, both end portions in the up-down direction on the opening edge of the recess portion 33 are also formed with tapered surfaces 34*b* (see FIG. 6A) serving as guide surfaces whose width in the up-down direction progressively decreases toward the front side. The tapered surface 34*b* is provided generally extending over the entire area of the recess portion 33 in the left-right direction.

Both end portions in the left-right direction of the bottom surface 33*a* of the recess portion 33 are formed with contact surfaces 35*a* that closely contact the tapered surfaces 27*a* of the guide projections 27 provided on the connector portion 25 of the holder device 12. In addition, the bottom surface 33*a* of the recess portion 33 is formed with contact surfaces 35*b* (see FIG. 6A) that closely contact the tapered surfaces 27*b* of the guide projections 27 provided on the connector portion 25 of the holder device 12. The contact surface 35*b* is provided generally extending over the entire area of the recess portion 33 in the left-right direction.

The holder device 12 is designed such that, even if the hard disk device 11 inserted into the holder body 13 is relatively shifted in the left-right direction with respect to the holder body 13, the connector portion 25 on the holder device 12 side can guide the connector portion 32 on the hard disk device 11 side in the left-right direction. Specifically, a shift amount by which the connector portion 25 on the holder device 12 side should be shifted with respect to the holder body 13 is calculated in consideration of a design error of the through hole 28 formed in the connector body 14, a design error of the shoulder screw 29, and a design error of the screw hole 21 formed in the back plate 16 of the holder body 13. Based on this calculated value, requirements pertaining to the size of the through hole 28, and the formation position of the through hole 28 in the connector body 14 are determined. The requirements will be explained below.

As illustrated in FIG. 3A, a center axis S1 passes through the center position in the up-down direction and the left-right direction of the connector body 14. The center axis S1 is located at the center position of a mobile area of the connector body 14 with respect to the holder body 13. With regard to the center axis S1 and the hole edge of the through hole 28, a distance in the left-right direction from the center axis S1 to the hole edge region located on the far side from center axis S1 is expressed as $A_X \pm \delta_{AX}$. Note that $A_X$ refers to a design value for a left-right dimension of the through hole 28 when forming the through hole 28 in the plate portion 24 of the connector body 14, and $\delta_{AX}$ refers to a design error in the left-right direction of the through hole 28 when forming the through hole 28 in the plate portion 24 of the connector body 14.

In a state with the shoulder screw 29 positioned in the center of the through hole 28, a distance in the left-right direction between the center axis S1 of the connector body 14 and a center axis S2 of the shoulder screw 29 is expressed as $B_X \pm \delta_{BX}$. Note that $B_X$ refers to a design value for a left-right dimension of the screw hole 21 when forming the screw hole 21 in the back plate 16 of the holder body 13, and $\delta_{BX}$ refers to a design error in the left-right direction of the screw hole 21 when forming the screw hole 21 in the back plate 16 of the holder body 13.

A radius of the shoulder portion 30 of the shoulder screw 29 is expressed as $C_X \pm \delta_{CX}$. Note that $C_X$ refers to a design value for a left-right dimension of the shoulder portion 30 when forming the shoulder portion 30 of the shoulder screw 29, and $\delta_{CX}$ refers to a design error in the left-right direction of the shoulder portion 30 when forming the shoulder portion 30 of the shoulder screw 29.

Figure 3B:
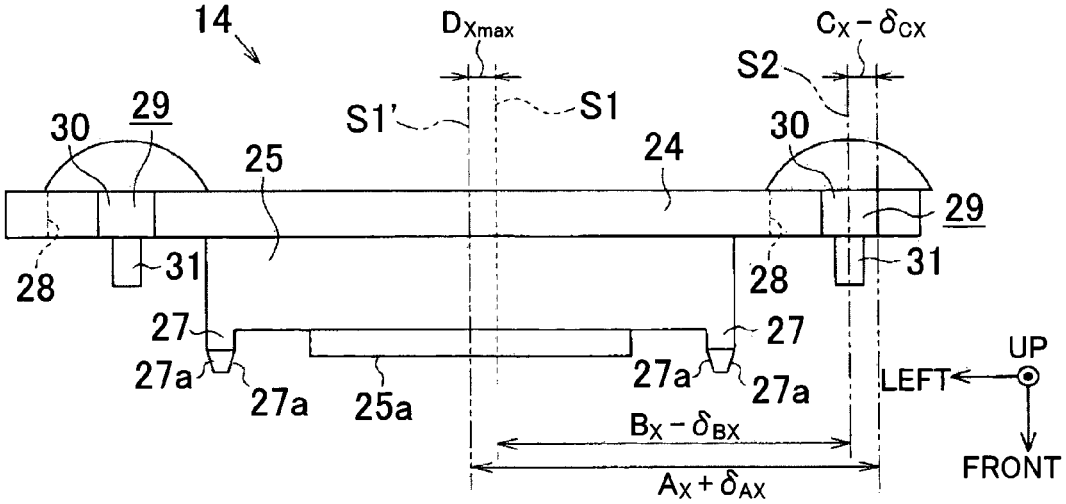
FIG. 3B is a plane view that shows the connector body shifted leftward with respect to the holder body.

Here, as illustrated in FIG. 3B, the connector body 14 is shifted leftward with respect to the holder body 13 to a position where the hole edge region of the through hole 28 contacts the shoulder portion 30 of the shoulder screw 29. Accordingly, the center axis S1 of the connector body 14 is also shifted leftward. Note that, in FIG. 3B, the center axis S1 before shifting is indicated by a dashed line, and a center axis S1' after shifting is indicated by a double-dashed line (likewise in FIG. 4A and subsequent drawings). In this case, giving consideration to the design errors of the through hole 28, the screw hole 21, and the shoulder screw 29, a maximum value $D_{Xmax}$ of the shift amount that the connector body 14 can be shifted leftward is expressed by Equation 1.

$$D_{Xmax}=(A_X+\delta_{AX})-(B_X-\delta_{BX})-(C_X-\delta_{CX})=(A_X-B_X-C_X)+(\delta_{AX}+\delta_{BX}+\delta_{CX}) \quad \text{[Equation 1]}$$

Figure 4A:
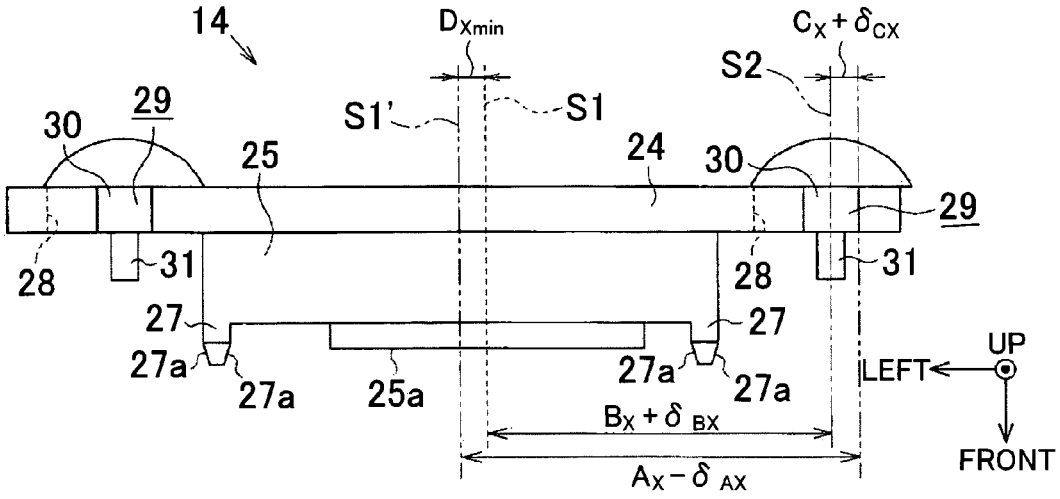
FIG. 4A is a plane view that shows the connector body shifted leftward with respect to the holder body.

Similarly, as illustrated in FIG. 4A, giving consideration to the design errors of the through hole 28, the screw hole 21, and the shoulder screw 29, a minimum value $D_{Xmin}$ of the shift amount that the connector body 14 can be shifted leftward with respect to the holder body 13 is expressed by Equation 2.

$$D_{Xmin}=(A_X-\delta_{AX})-(B_X+\delta_{BX})-(C_X-\delta_{CX})=(A_X-B_X-C_X)-(\delta_{AX}+\delta_{BX}+\delta_{CX}) \quad \text{[Equation 2]}$$

Equation 3 can be obtained by substituting Equation 2 into Equation 1.

$$D_{Xmax}=D_{Xmin}+2\times(\delta_{AX}+\delta_{BX}+\delta_{CX}) \quad \text{[Equation 3]}$$

Figure 4B:
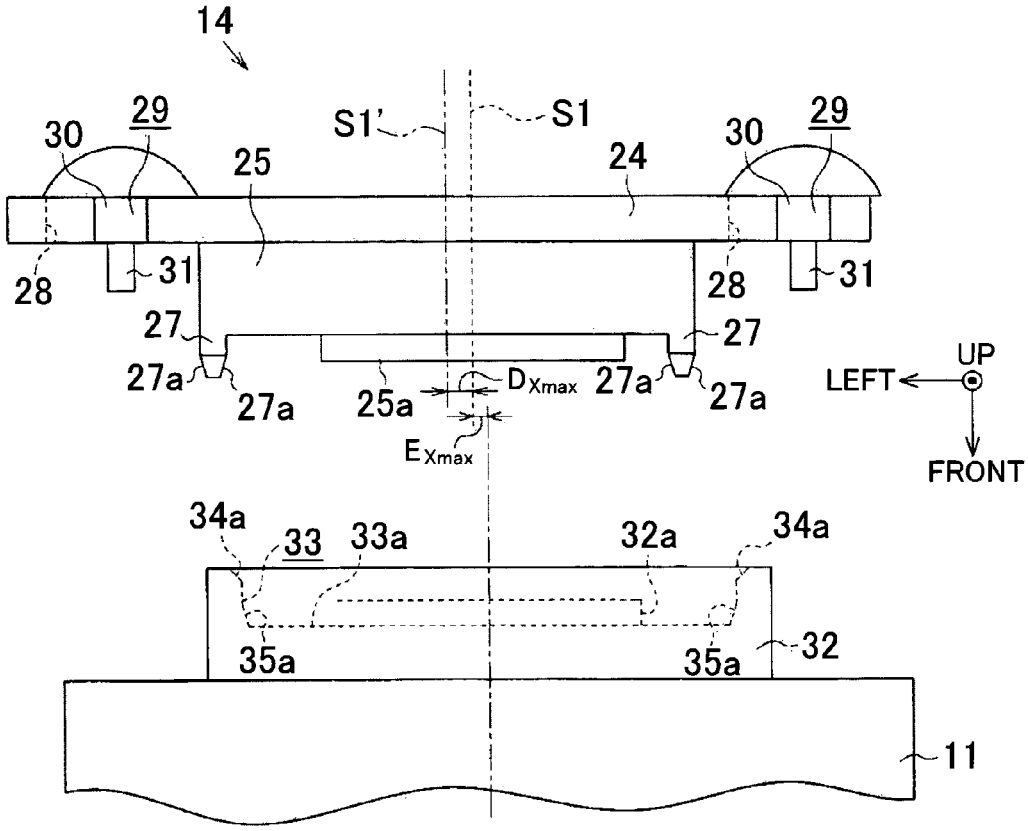
FIG. 4B is a plane view that shows the connector body most shifted in the left-right direction with respect to the hard disk device.

As illustrated in FIG. 4B, a maximum value $E_{Xmax}$ is a misalignment amount that the hard disk device 11 can be misaligned rightward with respect to the center position in the left-right direction of the holder body 13. Specifically, $E_{Xmax}$ is set as a virtual misalignment amount with respect to the center axis 51 that can be allowed for the connector portion 32 of the hard disk device 11. In this case, a maximum value of a relative shift amount that the connector portion 25 on the holder device 12 side can be relatively shifted in the left-right direction with respect to the connector portion 32 on the hard disk device 11 side is expressed as $D_{Xmax}+E_{Xmax}$.

Figure 5:
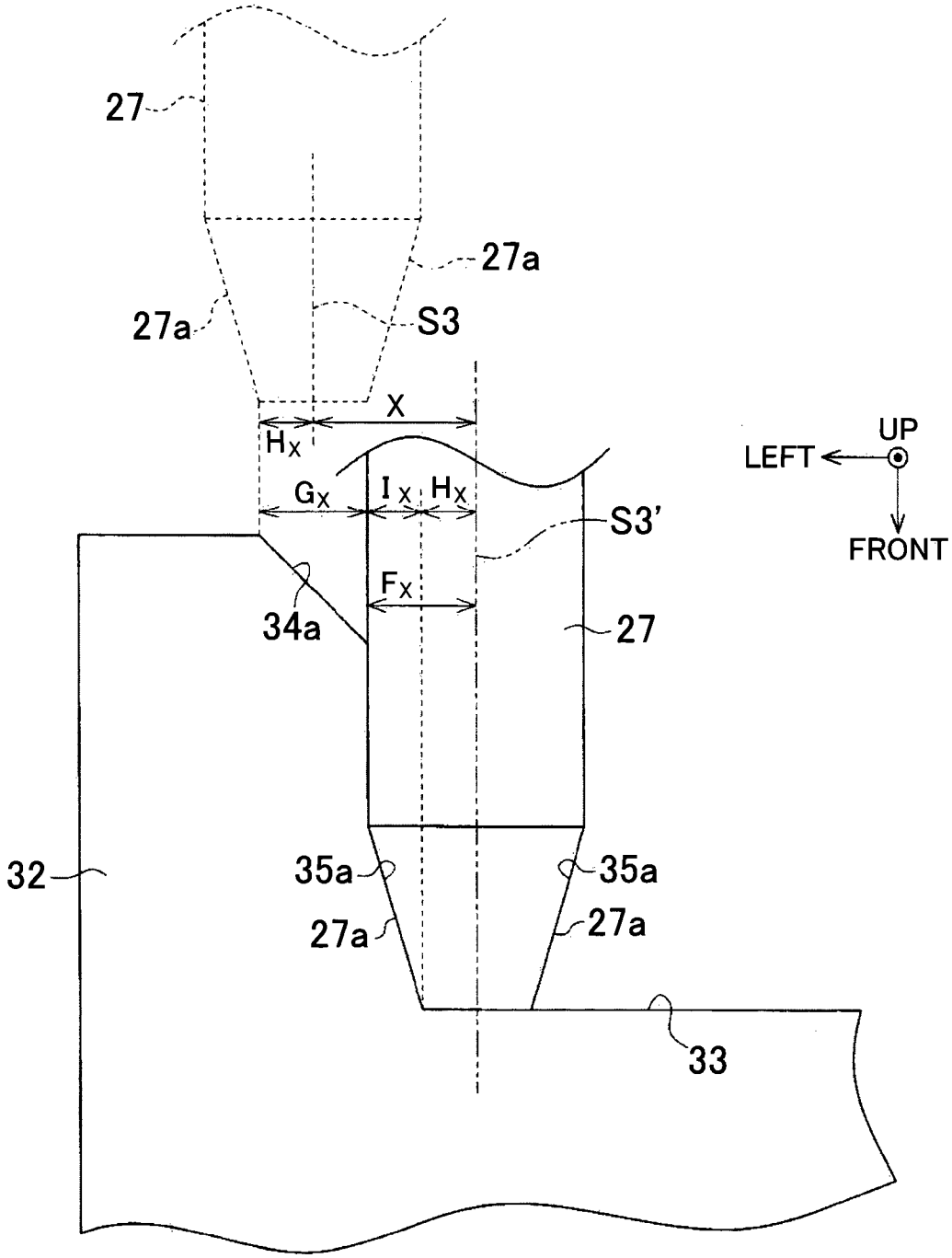
FIG. 5 is a plane view that shows a guide projection guided in the left-right direction by an inner surface of a recess portion.

Note that, as illustrated in FIG. 5, a mean diameter of the guide projection 27 is $F_X$; a left-right dimension of the tapered surface 34*a* formed on the recess portion 33 of the connector portion 32 is $G_X$; a left-right distance from a center axis S3, which passes through a cross-sectional center of the guide projection 27, to the tapered surface 27*a* of the guide projection 27 is $H_X$; and a left-right dimension of the tapered surface 27*a* formed on the distal end portion of the guide projection 27 is $I_X$. In this case, the mean diameter $F_X$ of the guide projection 27 is expressed by Equation 4. Note that, in FIG. 5, the center axis S3 of the guide projection 27 before being guided is indicated by a dashed line, and a center axis S3' of the guide projection 27 after being guided in the left-right direction is indicated by a double-dashed line.

$$F_X=H_X+I_X \quad \text{[Equation 4]}$$

By sliding the tapered surface 27*a* of the guide projection 27 against the tapered surface 34*a* positioned on the opening edge of the recess portion 33, the inner surface of the recess portion 33 of the connector portion 32 guides the guide projection 27 in the left-right direction. Equation 5 expresses a guidance amount X that the guide projection 27 is thus guided.

$$X=F_X+G_X-H_X \quad \text{[Equation 5]}$$

Equation 6 can be obtained by substituting Equation 4 into Equation 5.

$$X=G_X+I_X \quad \text{[Equation 6]}$$

Here, in order to ensure that the guide projection 27 of the connector portion 25 on the holder device 12 side in reliably guided in rightward by the inner surface of the recess portion 33 of the connector portion 32 on the hard disk device 11 side, the conditional expression shown in Equation 7 must be satisfied.

$$D_{Xmax}+E_{Xmax}\leq X \quad \text{[Equation 7]}$$

Guiding the guide projection 27 against the inner surface of the recess portion 33 enables alignment of the connector terminal 25*a* of the connector portion 25 on the holder device 12 side with the connector terminal 32*a* of the connector portion 32 on the hard disk device 11 side. In this state, the connector terminal 25*a* of the connector portion 25 on the holder device 12 side is connected to the connector terminal 32*a* of the connector portion 32 on the hard disk device 11 side.

Here, if the connector portion 32 on the hard disk device 11 side becomes misaligned rightward with respect to the connector portion 25 on the holder device 12 side in a state with the connector terminals 25*a*, 32*a* connected to each other, an unnecessary force is applied between the connector terminals 25*a*, 32*a*. Therefore, the connector portion 25 on the holder device 12 side, so as to reliably absorb such a misalignment, must follow the connector portion 32 on the hard disk device 11 side and shift rightward with respect to the holder body 13.

In other words, a shift amount of the connector portion 25 on the holder device 12 side rightward with respect to the holder body 13 must be set approximately equal to or greater than a misalignment amount of the connector portion 32 on the hard disk device 11 side rightward with respect to the holder body 13. On this point, in the present embodiment, in a state with the positions of the connector terminal 25*a* of the connector portion 25 on the holder device 12 side and the connector terminal 32*a* of the connector portion 32 on the hard disk device 11 side coincided, that is, with the shoulder portion 30 of the shoulder screw 29 positioned at the center of the through hole 28, the shift amounts that the connector portion 25 on the holder device 12 side can be shifted leftward and rightward with respect to the holder body 13 are practically the same. Thus, in the present embodiment, the application of an unnecessary force between the connector terminals 25*a*, 32*a* can be avoided so long as the conditional expression shown in Equation 8 is satisfied.

$$D_{Xmin}\leq E_{Xmax} \quad \text{[Equation 8]}$$

The conditional expression shown in Equation 9 can be obtained by substituting Equation 7 and Equation 8 into Equation 3.

$$E_{Xmax} \leq D_{Xmin} \leq X-2\times(\delta_{AX}+\delta_{BX}+\delta_{CX})-E_{Xmax} \Leftrightarrow E_{Xmax} \leq X/2-(\delta_{AX}+\delta_{BX}+\delta_{CX}) \quad \text{[Equation 9]}$$

The shift amount $E_{Xmax}$ that the holder body 13 can be shifted with respect to the hard disk device 11 is set so as to satisfy Equation 9. In addition, the maximum value $D_{Xmax}$ and the minimum value $D_{Xmin}$ of the shift amount that the connector body 14 should be shifted leftward with respect to the holder body 13 is determined by substituting the set $E_{Xmax}$ value into Equation 7 and Equation 8. Further, by substituting the determined. $D_{Xmax}$ value into Equation 1, or by substituting the determined $D_{Xmin}$ value into Equation 2, the design value $A_X$ of the through hole 28 when forming the through hole 28, the design value $B_X$ of the screw hole 21 when forming the screw hole 21, and the design value $C_X$ of the shoulder portion 30 of the shoulder screw 29 when designing the shoulder portion 30 of the shoulder screw 29 are determined.

Accordingly, the through hole 28, the screw hole 21, and the shoulder screw 29 are designed so as to satisfy the design values $A_X$, $B_X$, $C_X$ thus determined. As a consequence, the connector portion 25 of the holder device 12 can be reliably guided in the left-right direction by the connector portion 32 of the hard disk device 11 independent of the magnitude of the design errors $\delta_{AX}$, $\delta_{BX}$, $\delta_{CX}$ of the through hole 28, the screw hole 21, and the shoulder screw 29. At the same time, the connector portion 25 of the holder device 12 can absorb the misalignment of the connector terminals 25*a*, 32*a* in the left-right direction with respect to the connector portion 32 of the hard disk device 11.

Note that, for the distance in the left-right direction between the center axis S1 that passes through the center position of the connector body 14 and the hole edge region located on the nearest side in the left-right direction with respect to the center axis S1 of the hole edge of the through hole 28 as well, a suitable design value can be determined using the same method and assuming that the connector body 14 is shifted rightward with respect to the holder body 13 up to a position where the hole edge region of the through hole 28 contacts the shoulder portion 30 of the shoulder screw 29.

Figure 6A:
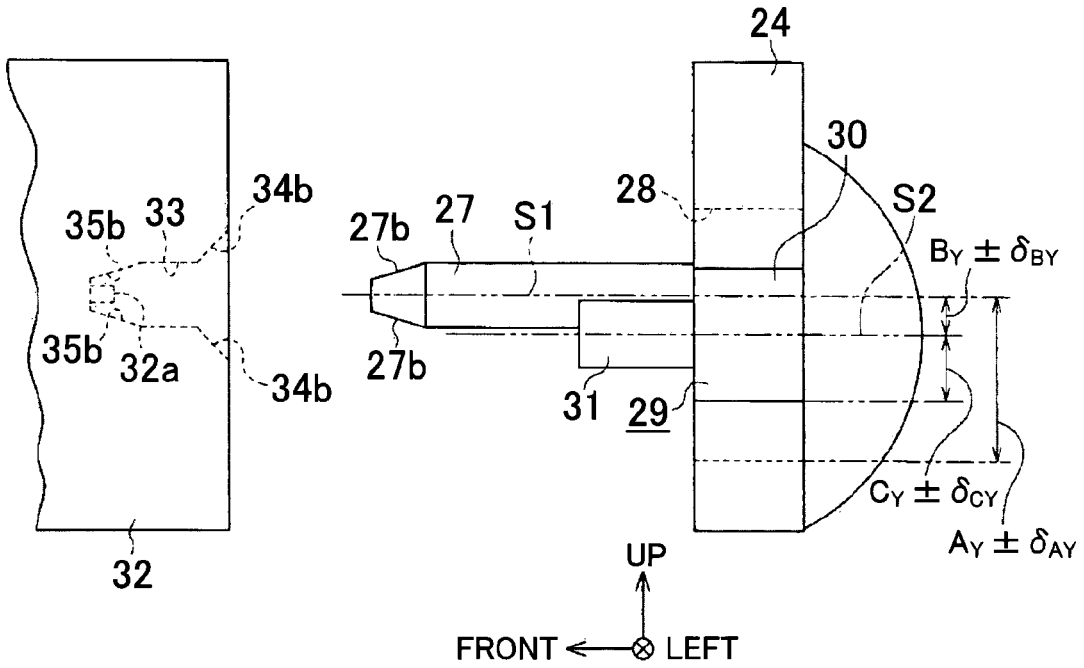
FIG. 6A is a side view of the connector portion of the hard disk device and the connector portion of the holder device.

Likewise, as illustrated in FIG. 6A, a distance in the left-right direction between the center axis S1 of the connector body 14 and a hole edge region located downward with respect to the center axis S1 of the hole edge of the through hole 28 is expressed as $A_Y \pm \delta_{AY}$. Note that $A_Y$ refers to a design value for an up-down dimension of the through hole 28 when forming the through hole 28 in the plate portion 24 of the connector body 14, and $\delta_{AY}$ refers to a design error in the up-down direction of the through hole 28 when forming the through hole 28 in the plate portion 24 of the connector body 14.

In a state with the shoulder screw 29 positioned in the center of the through hole 28, a distance in the up-down direction between the center axis S1 of the connector body 14 and the center axis S2 of the shoulder screw 29 is expressed as $B_Y \pm \delta_{BY}$. Note that $B_Y$ refers to a design value ($=B_X$) for an up-down dimension of the screw hole 21 when forming the screw hole 21 in the back plate 16 of the holder body 13, and $\delta_{BX}$ refers to a design error in the up-down direction of the screw hole 21 when forming the screw hole 21 in the back plate 16 of the holder body 13.

A radius of the shoulder portion 30 of the shoulder screw 29 is expressed as $C_Y \pm \delta_{CY}$. Note that $C_Y$ refers to a design value ($=C_X$) for an up-down dimension of the shoulder portion 30 when forming the shoulder portion 30 of the shoulder screw 29, and $\delta_{CY}$ refers to a design error in the up-down direction of the shoulder portion 30 when forming the shoulder portion 30 of the shoulder screw 29.

Figure 6B:
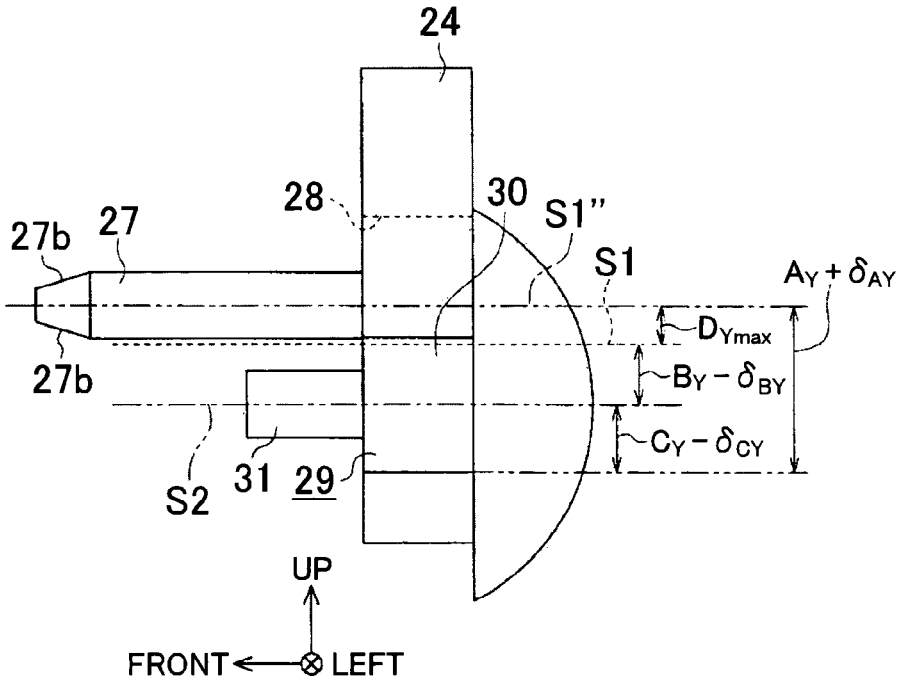
FIG. 6B is a side view that shows the connector body shifted upward with respect to the holder body.

Here, as illustrated in FIG. 6B, the connector body 14 is shifted upward with respect to the holder body 13 to a position where the hole edge region of the through hole 28 contacts the shoulder portion 30 of the shoulder screw 29. Accordingly, the center axis S1 of the connector body 14 is also shifted upward. Note that, in FIG. 6B, the center axis S1 before shifting is indicated by a dashed line, and a center axis S1" after shifting is indicated by a double-dashed line (likewise in FIG. 6A and subsequent drawings). In this case, giving consideration to the design errors of the through hole 28, the screw hole 21, and the shoulder screw 29, a maximum value $D_{Ymax}$ of the shift amount that the connector body 14 can be shifted upward is expressed by Equation 10.

$$D_{Ymax}=(A_Y+\delta_{AY})-(B_Y-\delta_{BY})-(C_Y-\delta_{CY})=(A_Y-B_Y-C_Y)+(\delta_{AY}+\delta_{BY}+\delta_{CY}) \quad \text{[Equation 10]}$$

Figure 7A:
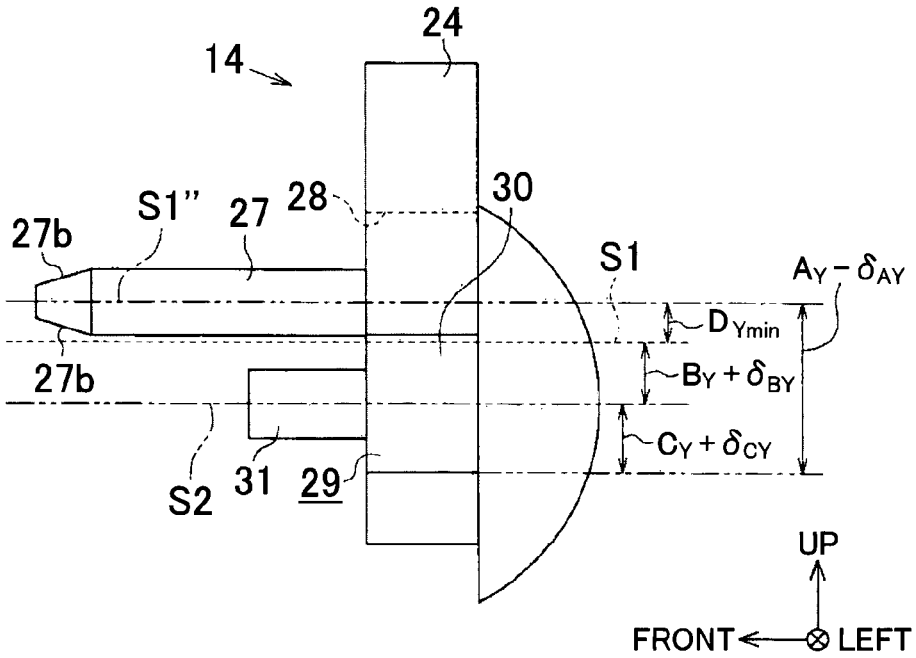
FIG. 7A is a side view that shows the connector body shifted upward with respect to the holder body.

Similarly, as illustrated in FIG. 7A, giving consideration to the design errors of the through hole 28, the screw hole 21, and the shoulder screw 29, a minimum value $D_{Ymin}$ expresses the shift amount that the connector body 14 can be shifted upward with respect to the holder body 13.

$$D_{Ymin}=(A_Y-\delta_{AY})-(B_Y+\delta_{BY})-(C_Y-\delta_{CY})=(A_Y-B_Y-C_Y)-(\delta_{AY}+\delta_{BY}+\delta_{CY}) \quad \text{[Equation 11]}$$

Equation 12 can be obtained by substituting Equation 11 into Equation 10.

$$D_{Ymax}=D_{Ymin}+2\times(\delta_{AY}+\delta_{BY}+\delta_{CY}) \quad \text{[Equation 12]}$$

Figure 7B:
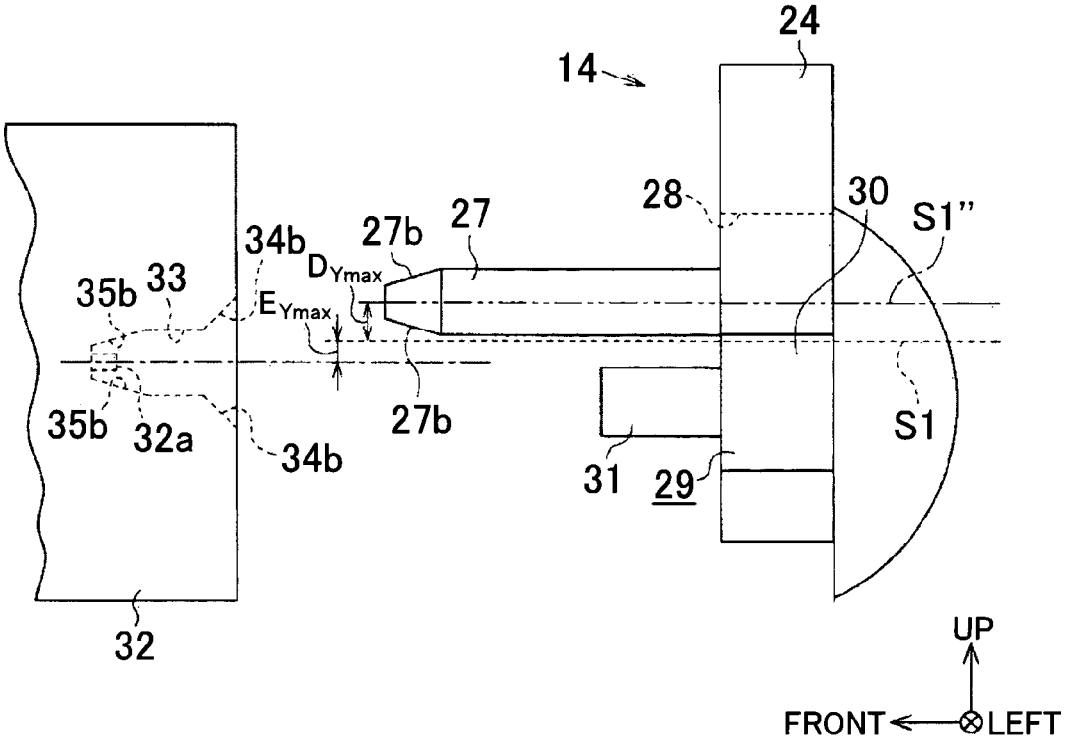
FIG. 7B is a side view that shows the connector body most relatively shifted in the up-down direction with respect to the hard disk device.

As illustrated in FIG. 7B, a maximum value $E_{Ymax}$ is a misalignment amount that the hard disk device 11 can be misaligned downward with respect to the center position in the up-down direction of the holder body 13. Specifically, $E_{Ymax}$ is set as a virtual misalignment amount with respect to the center axis $S_1$ that can be allowed for the connector portion 32 of the hard disk device 11. In this case, a maximum value of a relative shift amount that the connector portion 25 on the holder device 12 side can be relatively shifted in the up-down direction with respect to the connector portion 32 on the hard disk device 11 side is expressed as $D_{Ymax}+E_{Ymax}$.

Figure 8:
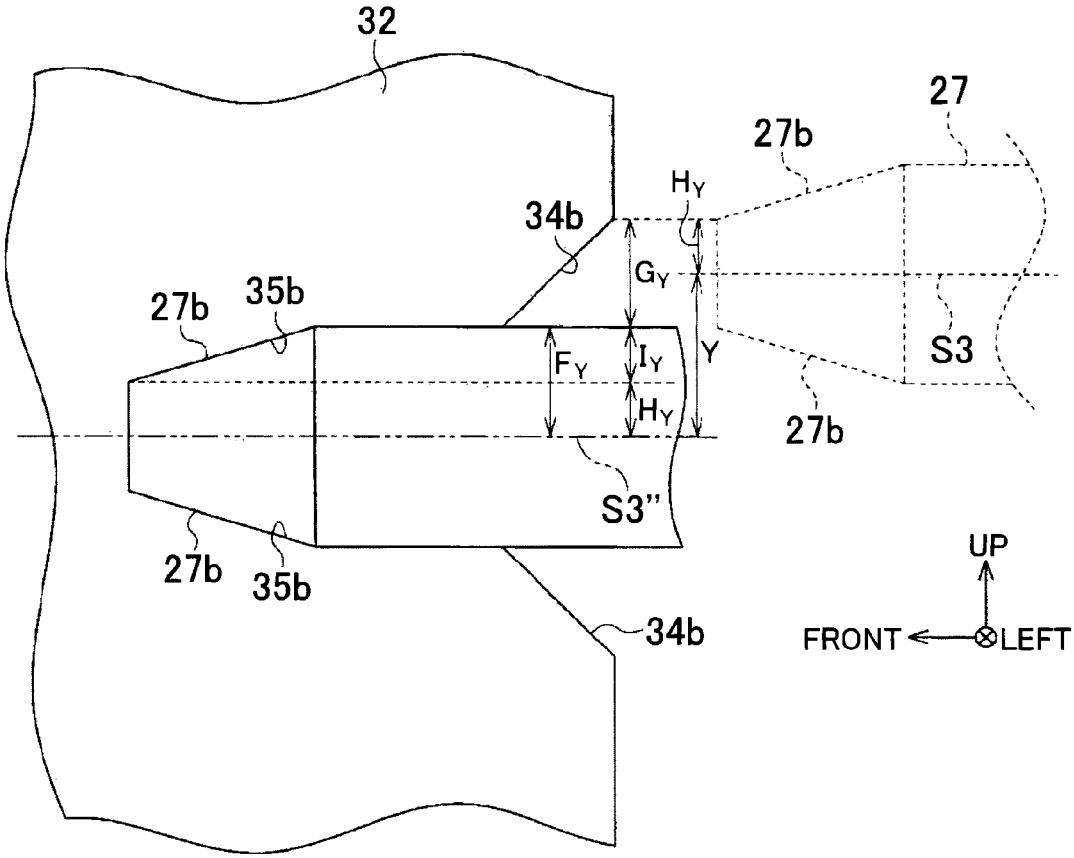
FIG. 8 is a side view that shows the guide projection guided in the up-down direction by the inner surface of the recess portion.

Note that, as illustrated in FIG. 8, a mean diameter of the guide projection 27 is $F_Y$; an up-down dimension of the tapered surface 34*b* formed on the recess portion 33 of the connector portion 32 is $G_Y$; an up-down distance from the center axis S3, which passes through a center position of the guide projection 27, to the tapered surface 27*b* of the guide projection 27 is $H_Y$; and an up-down dimension of the tapered surface 27*b* formed on the distal end portion of the guide projection 27 is $I_Y$. In this case, the mean diameter $F_Y$ of the guide projection is expressed by Equation 13. Note that, in FIG. 8, the center axis S3 of the guide projection 27 before being guided is indicated by a dashed line, and a center axis S3" of the guide projection 27 after being guided in the up-down direction is indicated by a double-dashed line.

$$F_Y=H_Y+I_Y \quad \text{[Equation 13]}$$

By sliding the tapered surface 27*b* of the guide projection 27 against the tapered surface 34*b* positioned on the opening edge of the recess portion 33, the inner surface of the recess portion 33 of the connector portion 32 guides the guide projection 27 in the up-down direction. Equation 14 expresses a guidance amount Y that the guide projection 27 is thus guided.

$$Y=F_Y+G_Y-H_Y \quad \text{[Equation 14]}$$

Equation 15 can be obtained by substituting Equation 13 into Equation 14.

$$Y=G_Y+I_Y \quad \text{[Equation 15]}$$

Here, in order to ensure that the guide projection 27 of the connector portion 25 on the holder device 12 side is reliably guided upward by the inner surface of the recess portion 33 of the connector portion 32 on the hard disk device 11 side, the conditional expression shown in Equation 16 must be satisfied.

$$D_{Ymax}+E_{Ymax}\leq Y \quad \text{[Equation 16]}$$

Guiding the guide projection 27 against the inner surface of the recess portion 33 enables alignment of the connector terminal 25*a* of the connector portion 25 on the holder device 12 side with the connector terminal 32*a* of the connector portion 32 on the hard disk device 11 side. In this state, the connector terminal 25*a* of the connector portion 25 on the holder device 12 side is connected to the connector terminal 32*a* of the connector portion 32 on the hard disk device 11 side.

Here, if the connector portion 32 on the hard disk device 11 side becomes misaligned downward with respect to the connector portion 25 on the holder device 12 side in a state with the connector terminals 25*a*, 32*a* connected to each other, an unnecessary force is applied between the connector terminals 25*a*, 32*a*. Therefore, the connector portion 25 on the holder device 12 side, so as to reliably absorb such a misalignment, must follow the connector portion 32 on the hard disk device 11 side and shift downward with respect to the holder body 13.

In other words, a shift amount of the connector portion 25 on the holder device 12 side downward with respect to the holder body 13 must be set approximately equal to or greater than a misalignment amount of the connector portion 32 on the hard disk device 11 side downward with respect to the holder body 13. On this point, in the present embodiment, in a state with the positions of the connector terminal 25*a* of the connector portion 25 on the holder device 12 side and the connector terminal 32*a* of the connector portion 32 on the hard disk device 11 side coincided, that is, with the shoulder portion 30 of the shoulder screw 29 positioned at the center of the through hole 28, the shift amounts that the connector body 14 can be shifted upward and downward with respect to the holder body 13 are practically the same. Thus, in the present embodiment, the application of an unnecessary force between the connector terminals 25*a*, 32*a* can be avoided so long as the conditional expression shown in Equation 17 is satisfied.

$$D_{Ymin}\geq E_{Ymax} \quad \text{[Equation 17]}$$

The conditional expression shown in Equation 18 can be obtained by substituting Equation 16 and Equation 17 into Equation 12.

$$E_{Ymax}\leq D_{Ymin}\leq Y-2\times(\delta_{AY}+\delta_{BY}+\delta_{CY})-E_{Ymax} \Leftrightarrow E_{Ymax}\leq Y/2-(\delta_{AY}+\delta_{BY}+\delta_{CY}) \quad \text{[Equation 18]}$$

The shift amount $E_{Ymax}$ that the holder body 13 can be shifted with respect to the hard disk device 11 is set so as to satisfy Equation 18. In addition, the maximum value $D_{Ymax}$ and the minimum value $D_{Ymin}$ of the shift amount that the connector body 14 should be shifted upward with respect to the holder body 13 is determined by substituting the set $E_{Ymax}$ value into Equation 16 and Equation 17. Further, by substituting the determined $D_{Ymax}$ value into Equation 10, or by substituting the determined $D_{Ymin}$ value into Equation 11, the design value $A_Y$ of the through hole 28 when forming the through hole 28, the design value $B_Y$ of the screw hole 21 when forming the screw hole 21, and the design value $C_Y$ of the shoulder portion 30 of the shoulder screw 29 when designing the shoulder portion 30 of the shoulder screw 29 are determined.

Accordingly, the through hole 28, the screw hole 21, and the shoulder screw 29 are designed so as to satisfy the design values $A_Y$, $B_Y$, $C_Y$ thus determined. As a consequence, the connector portion 25 of the holder device 12 can be reliably guided in the up-down direction by the connector portion 32 of the hard disk device 11 independent of the magnitude of the design errors $\delta_{AY}$, $\delta_{BY}$, $\delta_{CY}$ of the through hole 28, the screw hole 21, and the shoulder screw 29. At the same time, the connector portion 25 of the holder device 12 can absorb the misalignment of the connector terminals 25*a*, 32*a* in the up-down direction with respect to the connector portion 32 of the hard disk device 11.

Note that, for the distance in the up-down direction between the center axis $S_1$ that passes through the center position of the connector body 14 and the hole edge region located upward with respect to the center axis S1 of the hole edge of the through hole 28 as well, a suitable design value can be determined using the same method and assuming that the connector body 14 is shifted downward with respect to the holder body 13 up to a position where the hole edge region of the through hole 28 contacts the shoulder portion 30 of the shoulder screw 29.

Next, the operation of the navigation device having the above constitution will be described.

When mounting the hard disk device 11 to the holder device 12, first, the hard disk device 11 is inserted from the insertion opening 23 formed on the front surface side of the holder body 13. By then pressing the hard disk device 11 toward the inward side of the holder body 13, the connector portion 32 provided on the back surface (distal surface) of the hard disk device 11 approaches the connector portion 25 of the holder device 12 that is provided so as to project forward from the back plate 16 of the holder body 13.

Once the connector portion 25 of the holder device 12 is near the connector portion 32 of the hard disk device 11, the connector portion 32 of the hard disk device 11 approaches the guide projections 27 that project toward the hard disk device 11 side from the front surface of the connector portion 25 of the holder device 12. Accordingly, the distal ends of the guide projections 27 provided on the holder device 12 side are inserted into the recess portion 33 formed on the back surface of the connector portion 32 of the hard disk device 11.

Here, the tapered surfaces 27*a* of the guide projections 27 on the connector portion 25 of the holder device 12 are disposed at positions where they can be guided in the left-right direction by the tapered surfaces 34*a* formed on the opening edge of the recess portion 33 in the connector portion 32 of the hard disk device 11. Similarly, the tapered surfaces 27*b* of the guide projections 27 on the connector portion 25 of the holder device 12 are disposed at positions where they can be guided in the up-down direction by the tapered surfaces 34*b* formed on the opening edge of the recess portion 33 in the connector portion 32 of the hard disk device 11. Therefore, once the distal end sides of the guide projections 27 are inserted into the recess portion 33, the tapered surfaces 27*a* of the guide projections 27 slide against the tapered surfaces 34*a* of the recess portion 33, and the tapered surfaces 27*b* of the guide projections 27 slide against the tapered surfaces 34*b* of the recess portion 33. As a consequence, a pressing force from the connector portion 32 of the hard disk device 11 acts on the connector portion 25 of the holder device 12, thus shifting the connector body 14 fixed with the connector portion 25 in the up-down direction and the left-right direction with respect to the holder body 13 in the holder device 12.

In other words, even if the connector portion 32 of the hard disk device 11 is inserted while misaligned in the up-down direction or the left-right direction with respect to the connector portion 25 of the holder device 12, the inner surface of the recess portion 33 provided in the connector portion 32 of the hard disk device 11 shifts with respect to the holder body 13 while guiding the guide projections 27 provided on the connector portion 25 of the holder device 12 in the up-down direction and the left-right direction. Therefore, the connector portion 32 of the hard disk device 11 and the connector portion 25 of the holder device 12 are connected in a state of mutual alignment, and the connector terminal 32*a* of the connector portion 32 of the hard disk device 11 and the connector terminal 25*a* of the connector portion 25 of the holder device 12 are thus surely connected.

In addition, once the connector portion 32 of the hard disk device 11 is connected to the connector portion 25 of the holder device 12, the position of connector terminal 25*a* of the connector portion 25 on the holder device 12 side coincides with the position of the connector terminal 32*a* of the connector portion 32 on the hard disk device 11 side. Accordingly, the connector body 14 shifts in the up-down direction and the left-right direction with respect to the holder body 13 such that the shoulder portion 30 of the shoulder screw 29 is disposed at the center portion of the through hole 28 formed in the connector body 14.

Here, the shift amount that the connector body 14 can be shifted in the up-down direction and the left-right direction with respect to the holder body 13 is set to approximately equal to or greater than the misalignment amount of the hard disk device 11 in the same direction with respect to the holder body 13. Therefore, in a state with the connector portion 25 of the holder device 12 and the connector portion 32 of the hard disk device 11 connected, even if the hard disk device 11 becomes misaligned in the up-down direction and the left-right direction with respect to the holder body 13, the connector body 14 shifts with respect to the holder body 13 such that the connector portion 25 of the holder device 12 follows the connector portion 32 of the hard disk device 11.

In other words, in a state with the connector portion 25 of the holder device 12 and the connector portion 32 of the hard disk device 11 connected to each other, even if the hard disk device 11 becomes misaligned with respect to the holder body 13, the connector portion 25 of the holder device 12 shifts so as to follow the connector portion 32 of the hard disk device 11. Therefore, an unnecessary force does not act between the connector portion 25 of the holder device 12 and the connector portion 32 of the hard disk device 11. This consequently reduces strain-caused stress that acts on soldered portions between the connector terminals 25*a*, 32*a* of the connector portions 25, 32 and the circuit boards to which the connector terminals 25*a*, 32*a* are connected. Accordingly, a reduction in the mechanical life of the soldered portions caused by operations to mount and detach the hard disk device 11 to and from the holder device 12 is suppressed.

According to the present embodiment, the following effects can be obtained.

(1) The connector portion 25 of the holder device 12 is connected to the connector portion 32 of the hard disk device 11 while shifted with respect to the holder body 13. Here, the connector body 14 is shiftable with respect to the holder body 13 within a range that the guide projections 27 can be guided by the tapered surfaces 34*a*, 34*b* formed on the opening edge of the recess portion 33. Therefore, when the hard disk device 11 is inserted into the holder body 13, the guide projections 27 are surely guided by the tapered surfaces 34*a*, 34*b* of the recess portion 33 without adjusting the attachment of the connector body 14 to the holder body 13. Accordingly, at the time of insertion of the hard disk device 11 into the holder device 12, the connector terminal 32*a* of the connector portion 32 of the hard disk device 11 can be surely connected to the connector terminal 25*a* of the connector portion 25 of the holder device 12.

In addition, the connector body 14 is shiftable with respect to the holder body 13 within a range that the connector portion 25 of the holder device 12 can follow the connector portion 32 of the hard disk device 11. Therefore, after connecting the connector portions 25, 32, even if the connector portion 32 of the hard disk device 11 shifts with respect to the holder body 13 due to the hard disk device 11 becoming misaligned with respect to the holder body 13, the connector portion 25 of the holder device 12 shifts with respect to the holder body 13 so as to follow the connector portion 32 of the hard disk device 11. This consequently suppresses an unnecessary force from acting between the connector terminal 32*a* of the connector portion 32 of the hard disk device 11 and the connector terminal 25*a* of the connector portion 25 of the holder device 12. Thus, strain-caused stress that acts on the soldered portions between the connector terminals 25*a*, 32*a* of the connector portions 25, 32 and the circuit boards to which the connector terminals 25*a*, 32*a* are connected can be suppressed. It is also possible to avoid damage or the like to connector housings of the connector portions 25, 32 because unnecessary strain-caused stress that acts between the connector portions 25, 32 through the connector terminals 25*a*, 32*a* is suppressed. Further, since deformation of the connector terminals 25*a*, 32*a* is suppressed, there is practically no disruption in signals transmitted by each of the connector terminals 25*a*, 32*a* due to deformation of the connector terminals 25*a*, 32*a*. Accordingly, the reliability of the speed of communication between the holder device 12 and the hard disk device 11 can be improved.

(2) The gap formed between the shoulder screw 29 and the through hole 28, in a state with the shoulder screw 29 positioned at the center of the through hole 28, is greater than the misalignment amount that the hard disk device 11 can be misaligned with respect to the holder body 13 in a direction that intersects the insertion direction of the hard disk device 11. This is because a dimension of the gap in the same direction is smaller than the amount by which the guidance projections 27 are guided in the same direction by the tapered surfaces 34*a*, 34*b* located on the opening edge of the recess portion 33, and also because the connector terminal 32*a* of the connector portion 32 of the hard disk device 11 and the connector terminal 25*a* of the connector portion 25 of the holder device 12 are aligned.

Therefore, when the shoulder screw 29 attaches the connector body 14 to the holder body 13, the shift amount that the connector body 14 can be shifted with respect to the holder body 13 is set smaller than the guidance amount that the guide projections 27 are guided by the tapered surfaces 34*a*, 34*b* of the recess portion 33, and set larger than the amount that the hard disk device 11 is misaligned with respect to the holder body 13. Accordingly, at the time of insertion of the hard disk device 11 into the holder body 13, the connector terminal 32*a* of the connector portion 32 of the hard disk device 11 can be surely connected to the connector terminal 25*a* of the connector portion 25 of the holder device 12, and an unnecessary force acting between the connector terminals 25*a*, 32*a* can be suppressed.

(3) The shoulder screw 29 includes the shoulder portion 30 on the base end side of the shoulder screw 29 in the axial direction, and also includes the screw portion 31 that has a smaller diameter than the shoulder portion 30 and is positioned more toward the distal end side of the shoulder screw 29 in the axial direction than the shoulder portion 30. The screw portion 31 of the shoulder screw 29 is threadedly fastened to the screw hole 21 formed in the holder body 13 with a gap interposed between the inner surface of the through hole 28 and the shoulder portion 30. Therefore, a simple constitution in which the connector body 14 is shiftably attached to the holder body can be achieved.

(4) When the hard disk device 11 is inserted into the holder body 13, the hard disk device 11 is held in the up-down direction by the elastic tab portions 18 formed in the bottom plate 15 of the holder body 13 and the extension portions 22 formed on the side plate 17 of the holder body 13. Therefore, the hard disk device 11 is mounted to the holder body 13 in a non-shiftable manner. Accordingly, even if vibrations propagate to the holder body 13 from outside for example, the connector terminal 32*a* of the connector portion 32 of the hard disk device 11 can be stably connected to the connector terminal 25*a* of the connector portion 25 of the holder device 12.

(5) By simply inserting the hard disk device 11 in one direction with respect to the holder device 12, the connector terminal 32*a* of the connector portion 32 of the hard disk device 11 is connected to the connector terminal 25*a* of the connector portion 25 of the holder device 12. Therefore, when the holder device 12 is accommodated inside a housing that surrounds the periphery of the holder device 12, even if the connector portion 25 of the holder device 12 is located at a position on the inward side of the housing, there is no need to disassemble the housing to connect the connector terminals 25*a*, 32*a*. Accordingly, the connector terminal 32*a* of the connector portion 32 of the hard disk device 11 and the connector terminal 25*a* of the connector portion 25 of the holder device 12 can be connected by a simple operation.

(6) A constitution is achieved in which moving the connector body 14 with respect to the holder body 13 enables movement of the connector terminal 25*a* of the connector portion 25 of the holder device 12 with respect to the connector terminal 32*a* of the connector portion 32 of the hard disk device 11. In other words, it is not necessary to provide a mechanism for moving the connector terminal 25*a* inside the connector portion 25 of the holder device 12 to absorb a misalignment between the connector terminals 25*a*, 32*a*. Therefore, the connector terminal 25*a* of the connector portion 25 of the holder device 12 can be designed with greater freedom. It is thus easier to achieve a constitution for suppressing impedance mismatching that occurs in the connected terminal 25*a* of the connector portion 25 of the holder device 12. Consequently, high-speed transmission can be smoothly performed between the holder device 12 and the hard disk device 11.

(7) The screw portion 31 of the shoulder screw 29 has a smaller diameter than the shoulder portion 30 and is threadedly fastened to the screw hole 21. Here, the screw hole 21 is formed by burring the back plate 16 of the holder body 13 to form a circular-shaped depressed region in the back plate 16 of the holder body 13, and then threading the inner circumferential surface of the depressed region. Therefore, when threadedly fastening the shoulder screw 29 to the screw hole 21, the shoulder portion 30 of the shoulder screw 29 can be prevented from becoming embedded in the screw hole 21.

(8) When inserting the hard disk device 11 into the holder body 13, the inner surfaces of the pair of side plates 17 of the holder body 13 slide against the side surfaces of the hard disk device 11. Accordingly, the sliding movement of the holder body 13 in the insertion direction of the hard disk device 11 can be guided by the pair of side plates 17.

Note that the embodiment described above may be modified to realize other embodiments such as those below.

- In the embodiment described above, a guide projection may be provided on the connector portion 32 of the hard disk device 11, and a recess portion that fits with the guide projection may be provided in the connector portion 25 of the holder device 12. In such case, the guide projection provided on the connector portion 32 of the hard disk device 11 functions as a guide portion, and the recess portion provided in the connector portion 25 of the holder device 12 functions as a guided portion that slides against the guide projection. Further, any configuration may be adopted for the guide portion and the guided portion respectively provided on the connector portions 25, 32 so long as the configurations used can fit together in a projection-recess fashion.
- In the embodiment described above, a pressing spring may be disposed on the inner surface of the holder body 13. In such case, when the hard disk device 11 is inserted into the holder body 13, the pressing spring biases so as to press the side surface of the hard disk device 11 against the inner surface of the holder body 13. As a consequence, the hard disk device 11 is held between the pressing spring and the inner surface of the holder body 13 in the up-down direction and the left-right direction, which intersect the insertion direction of the hard disk device 11, whereby the hard disk device 11 is mounted to the holder body 13 in a non-shiftable manner. Note that the pressing spring is not a required element, and a constitution that does not include the pressing spring is conceivable.
- In the embodiment described above, a connector of a different communication type such as a parallel ATA type may be used as the connector portion 32 of the hard disk device 11 and the connector portion 25 of the holder device 12.
- In the embodiment described above, the shape of the through hole 28 formed in the connector body 14 is not limited to a rectangular shape, and any shape may be used so long as the shape allows a gap to be interposed between the through hole 28 and the shoulder portion 30 of the shoulder screw 29.
- In the embodiment described above, the attachment member that attaches the connector body 14 to the holder body 13 is not limited, and an ordinary screw or the like may be used.
- In the embodiment described above, the electronic device mounted to the holder device 12 is not limited to the hard disk device 11. In other words, any electronic device may be used so long as the electronic device has a connector that connects to the connector portion 25 of the holder device 12.
- In the embodiment described above, the holder body 13 of the holder device 12 may have a constitution that is reversed in the up-down direction. In other words, the holder device 12 may be configured such that the hard disk device 11 is inserted into the holder body 13 in which the bottom plate 15 is disposed at a position above the back plate 16 and the side plates 17.
- In the embodiment described above, the holder body 13 may be configured such that the back plate 16 is provided extending from the pair of side plates 17, and the screw hole 21 that threadedly fastens with the screw portion 31 of the shoulder screw 29 is formed in the back plate 16.

The invention claimed is:

1. A connector coupling structure that, when an electronic device is inserted into a holder device, electrically connects a connector terminal of a first connector provided in the electronic device and a connector terminal of a second connector provided in the holder device, wherein the holder device includes a holder body into which the electronic device is inserted, and a connector body provided with the second connector is shiftably attached to the holder body, the first connector is provided with a guide portion that guides the second connector such that the connector terminal of the second connector aligns with the connector terminal of the first connector, the second connector is provided with a guided portion that is guided by the guide portion when the second connector is shifted, and the connector body, when a center position of a mobile area of the connector body with respect to the holder body is set as a reference position, is attached to the holder body shiftable, within a range that the second connector can follow the first connector shifted with respect to the reference position in a direction that intersects an insertion direction of the electronic device, and within a range that the guided portion can be guided by the guide portion, the connector coupling structure characterized in that a sum total of a first shift amount that the first connector can be shifted with respect to the reference position in the direction that intersects the insertion direction of the electronic device and a second shift amount that the second connector can be shifted with respect to the reference position in the same direction is smaller than a guidance amount that the guide portion moves the guided portion in the same direction during insertion of the electronic device into the holder body, and the second shift amount is larger than the first shift amount.

2. The connector coupling structure according to claim 1, wherein the guide portion has a guide surface that is inclined with respect to the insertion direction of the electronic device, and the guided portion has a guided surface that slides against the guide surface, and an amount that the guide portion guides the guided portion is a sum total of a dimension of the guide surface in a direction that the guided portion is guided by the guide portion and a dimension of the guided surface.

3. The connector coupling structure according to claim 1, wherein the holder body has a holding portion that holds the electronic device in the direction that intersects the insertion direction of the electronic device.

4. The connector coupling structure according to claim 1, further comprising:

a housing that accommodates therein the holder device so as to surround a periphery of the holder device, wherein the connector body is disposed on an inward side of the housing.

5. The connector coupling structure according to claim 1, wherein in consideration of design errors, a maximum value and a minimum value of the second shift amount are defined and a maximum value of the first shift amount is defined, a sum total of the maximum value of the first shift amount and the maximum value of the second shift amount is smaller than the guidance amount, and the minimum value of the second shift amount is larger than the maximum value of the first shift amount.

6. The connector coupling structure according to claim 5, wherein the connector body is formed with a through hole that penetrates in the insertion direction of the electronic device, and an attachment member that attaches the connector body to the holder body is inserted into the through hole with a gap in the direction that intersects the insertion direction of the electronic device interposed between the attachment member and the through hole, and the gap formed between the attachment member and the through hole, with the connector body located at the center position of the mobile area with respect to the holder body, has a dimension in the direction that intersects the insertion direction of the electronic device that corresponds to the shift amount that the connector body can be shifted with respect to the reference position in the same direction.

7. The connector coupling structure according to claim 6, wherein the attachment member is a shoulder screw that has a non-screw portion on a base end side thereof in an axial direction, and has a screw portion with a smaller diameter than the non-screw portion more toward a distal end side thereof in the axial direction than the non-screw portion, and a dimension of the non-screw portion in the axial direction is set larger than a dimension of the through hole in the same direction, and the screw portion is threadedly fastened to the holder body with a gap interposed between the non-screw portion and an inner surface of the through hole.

8. A holder device comprising:

a holder body that is inserted with an electronic device;

a second connector that has a connector terminal that electrically connects to a connector terminal of a first connector provided in the electronic device when the electronic device is inserted into the holder body; and an attachment member that shiftably attaches the connector body provided with the second connector to the holder body, wherein the second connector is provided with a guided portion that is guided by a guide portion provided on the first connector when the second connector is shifted, and the attachment member, when a center position of a mobile area of the connector body with respect to the holder body is set as a reference position, attaches the connector body to the holder body shiftable within a range that the second connector can follow the first connector shifted from the reference position in a direction that intersects an insertion direction of the electronic device, and within a range that the guided portion can be guided by the guide portion, the holder device characterized in that a sum total of a first shift amount that the first connector can be shifted with respect to the reference position in the direction that intersects the insertion direction of the electronic device and a second shift amount that the second connector can be shifted with respect to the reference position in the same direction is smaller than a guidance amount that the guide portion moves the guided portion in the same direction during insertion of the electronic device into the holder body, and the second shift amount is larger than the first shift amount.

* * * * *